US007198420B2

(12) United States Patent
Yamamoto et al.

(10) Patent No.: US 7,198,420 B2
(45) Date of Patent: Apr. 3, 2007

(54) PRINTER

(75) Inventors: Minoru Yamamoto, Nagoya (JP); Takashi Okumura, Nagoya (JP); Hiroshi Taira, Ichinomiya (JP); Keiji Seo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/509,383

(22) PCT Filed: Feb. 26, 2003

(86) PCT No.: PCT/JP03/02166

§ 371 (c)(1),
(2), (4) Date: May 27, 2005

(87) PCT Pub. No.: WO03/082715

PCT Pub. Date: Oct. 9, 2003

(65) Prior Publication Data

US 2005/0214056 A1 Sep. 29, 2005

(30) Foreign Application Priority Data

Mar. 28, 2002 (JP) ..... 2002-092851

(51) Int. Cl.
*B65H 1/00* (2006.01)

(52) U.S. Cl. ..... 400/625; 400/636; 271/145; 271/161; 271/162

(58) Field of Classification Search ..... 400/624, 400/625, 636; 271/145, 161, 162
See application file for complete search history.

(56) References Cited

U.S. PATENT DOCUMENTS

| | | | | |
|---|---|---|---|---|
| 2,827,288 | A * | 3/1958 | Geisler | 271/24 |
| 4,349,186 | A * | 9/1982 | Nakamura | 271/18 |
| 4,813,660 | A * | 3/1989 | Dodd et al. | 271/11 |
| 6,065,747 | A * | 5/2000 | Khovaylo et al. | 271/209 |
| 6,561,506 | B2 * | 5/2003 | Sasaki et al. | 271/145 |
| 6,652,174 | B1 * | 11/2003 | Mann et al. | 400/691 |
| 2002/0056961 | A1 * | 5/2002 | Sasaki et al. | 271/145 |
| 2002/0140157 | A1 * | 10/2002 | Moore et al. | 271/107 |

FOREIGN PATENT DOCUMENTS

| | | | |
|---|---|---|---|
| JP | U 60-119034 | | 8/1985 |
| JP | U 62-5137 | | 1/1987 |
| JP | A 2-1381 | | 1/1990 |
| JP | A 2-172779 | | 7/1990 |
| JP | A 3-95029 | | 4/1991 |
| JP | 04020430 | * | 4/1992 |
| JP | A 6-293439 | | 10/1994 |
| JP | Y2 7-41743 | | 9/1995 |

* cited by examiner

*Primary Examiner*—Daniel J. Colilla
*Assistant Examiner*—Kevin D. Williams
(74) *Attorney, Agent, or Firm*—Oliff & Berridge, PLC

(57) ABSTRACT

A printer 1 includes a sheet storage unit 6 in which a stack of sheets can be set, a pickup roller 12 which contacts one side of the stack of sheets set in the sheet storage unit 6, and a lid 10 which covers the other side of the stack of sheets. In this structure, each sheet 7 is conveyed toward a print mechanism unit 14 by the revolution of the pickup roller 12. The printer 1 is provided with first ribs 10*a* and a second rib 3*a* which forcibly curl the sheets 7 set in the sheet storage unit 6 in the sheet width direction.

8 Claims, 6 Drawing Sheets

PRINTER

TECHNICAL FIELD

The present invention relates to a printer which feeds a print sheet and prints prescribed type of information on the surface of the sheet during the sheet feed process.

BACKGROUND OF THE INVENTION

Direct thermal printers equipped with a line thermal head have been well known. Into such a direct thermal printer, a plurality of heat-sensitive sheets in the form of cut sheets are stacked up and loaded.

The printer is provided with a pickup roller so as to make contact with one side of the stack of sheets set in a sheet storage unit of the printer. Each sheet is extracted from the stack by the revolution of the pickup roller and fed to a print mechanism unit one by one. In the print mechanism unit, each line on the sheet orthogonal to the sheet feed direction is heated by the thermal head, by which arbitrary letters, images, etc. are printed on the sheet.

In the vicinity of the pickup roller, a block part having a separation guide surface being tilted with respect to the sheet feed direction is placed. The separation guide surface, with which the front end of the sheet extracted from the stack by the pickup roller makes contact, exerts proper frictional force on the front end of the sheet and thereby performs a function promoting the separation of the sheets. Consequently, the sheets are separated from the stack one by one and fed toward a sheet supply side of the print mechanism unit.

DISCLOSURE OF THE INVENTION

The print sheets can warp and curl due to moisture absorption, etc., by which the sheet separation or feeding at the separation guide surface of the block part might become abnormal depending on the direction and extent of the curl, causing misfeeding of the sheets.

As shown in FIG. 6(*a*), for a satisfactory sheet separating function of the separation guide surface, the front end of the sheet 7 extracted from the stack by the pickup roller 12 has to make contact with the separation guide surface 13*a* straightly in a proper direction.

Meanwhile, when the front end of the sheet 7 gets substantially orthogonal to the separation guide surface 13*a* as shown in FIG. 6(*b*) due to upward curl of the sheet 7, the front end can not slide along the separation guide surface 13*a* and thereby the sheet 7 can not proceed downstream, resulting in misfeeding of the sheet 7.

On the other hand, when the front end of the sheet 7 heads downward to move along the separation guide surface 13*a* as shown in FIG. 6(*c*) due to downward curl of the sheet 7, the separating function of the separation guide surface 13*a* becomes insufficient, resulting in multi feeding in which two or more sheets are fed downstream at once.

It is therefore the primary object of the present invention to provide a printer capable of preventing the misfeeding and multi feeding from occurring when each sheet is extracted from a sheet supply unit of the printer by the revolution of the pickup roller.

In accordance with an aspect of the present invention, there is provided a printer including a sheet supply unit in which a stack of sheets can be set, a pickup roller which contacts and drives one side of the stack of sheets set in the sheet supply unit and thereby feeds each sheet toward a printing unit, and a cover which covers the other side of the stack of sheets set in the sheet supply unit. The printer is provided with a forcible curling unit which forcibly curls the sheets set in the sheet supply unit in a sheet width direction.

With this configuration, the sheets can be forcibly curled in the sheet width direction (orthogonal to the sheet feed direction), by which the front end of the sheet fed by the pickup roller makes contact with the separation guide surface in a correct direction. Consequently, the separation and feeding of the sheets can be carried out correctly and smoothly.

The forcible curling unit may include ribs which are provided to the cover to protrude toward the pickup roller so that tips of the ribs will press the stack of sheets set in the sheet supply unit at both sides in regard to the sheet width direction.

The forcible curling unit may include a rib which is provided inside the sheet supply unit to protrude toward the cover so that a tip of the rib will press the stack of sheets set in the sheet supply unit at its central part in regard to the sheet width direction.

In cases where the cover is provided with pressing means which applies pressure on the sheets set in the sheet supply unit toward the pickup roller, the forcible curling unit may include ribs which are provided to the pressing means to protrude toward the pickup roller so that tips of the ribs will press the stack of sheets set in the sheet supply unit at both sides in regard to the sheet width direction.

The printer may be configured so that the sheets will be set in the sheet supply unit in the form of a sheet package including a package member containing the sheets.

To solve the above mentioned problem, there is provided a printer including a sheet supply unit in which a stack of sheets can be set, a pickup roller which contacts and drives one side of the stack of sheets set in the sheet supply unit and thereby feeds each sheet toward a printing unit, and a sheet separation unit provided on a downstream side of the sheet supply unit in a sheet feed direction. The printer is provided with a forcible curling unit which forcibly curls the sheets in a sheet width direction at a position immediately before the sheet separation unit.

To solve the above mentioned problem, there is provided a sheet feeding mechanism including a sheet supply unit in which a stack of sheets can be set, a pickup roller which contacts and drives one side of the stack of sheets set in the sheet supply unit and thereby feeds each sheet toward a printing unit, a sheet separation unit placed on a downstream side of the sheet supply unit in a sheet feed direction, and a forcible curling unit which forcibly curls the sheets set in the sheet supply unit in a sheet width direction.

BEST MODE FOR CARRYING OUT THE INVENTION

Figure 1:
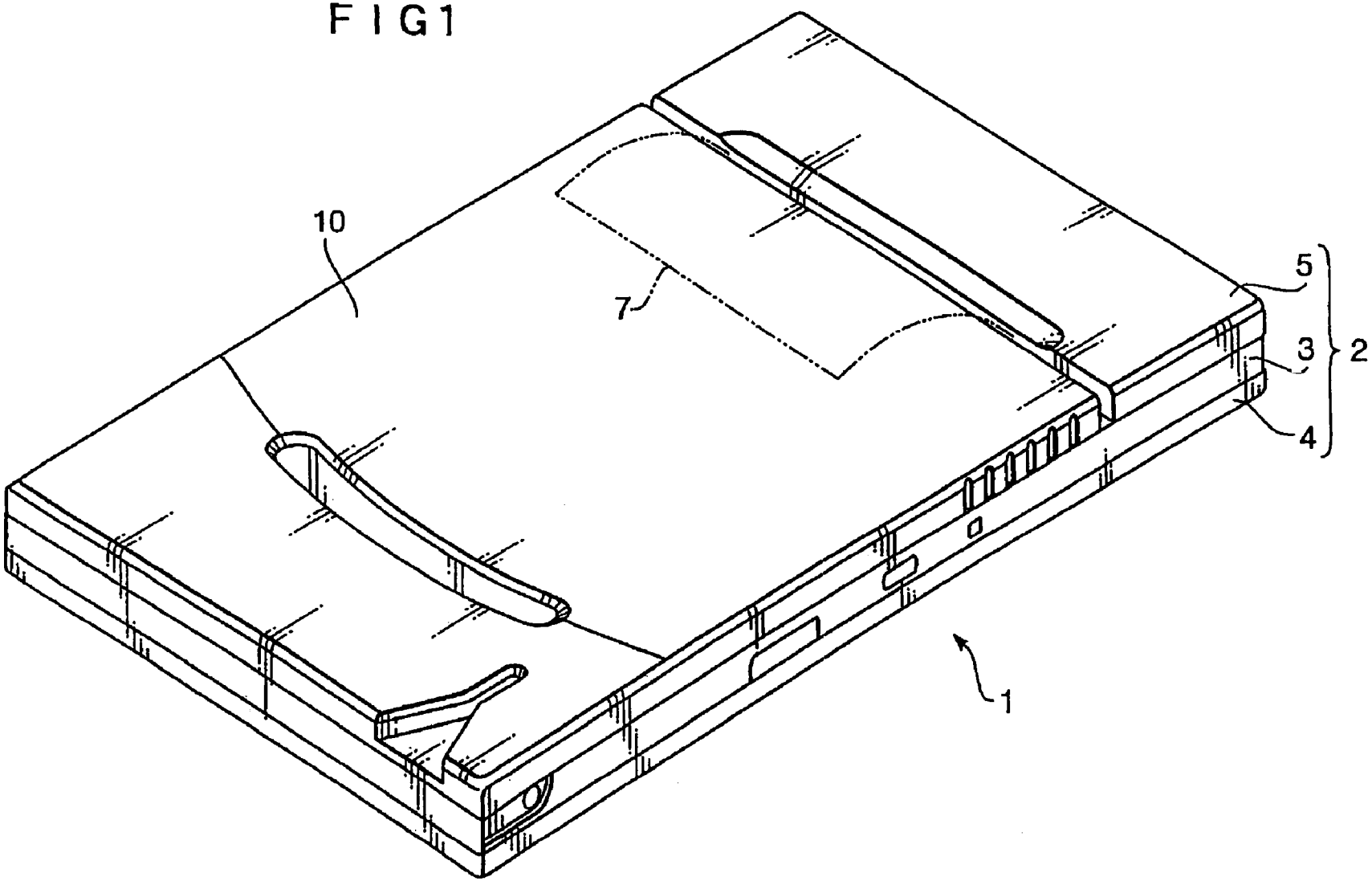
FIG. 1 is a perspective view of a printer in accordance with an embodiment of the present invention.

Referring now to the drawings, a description will be given in detail of preferred embodiments in accordance with the present invention.

Figure 2:
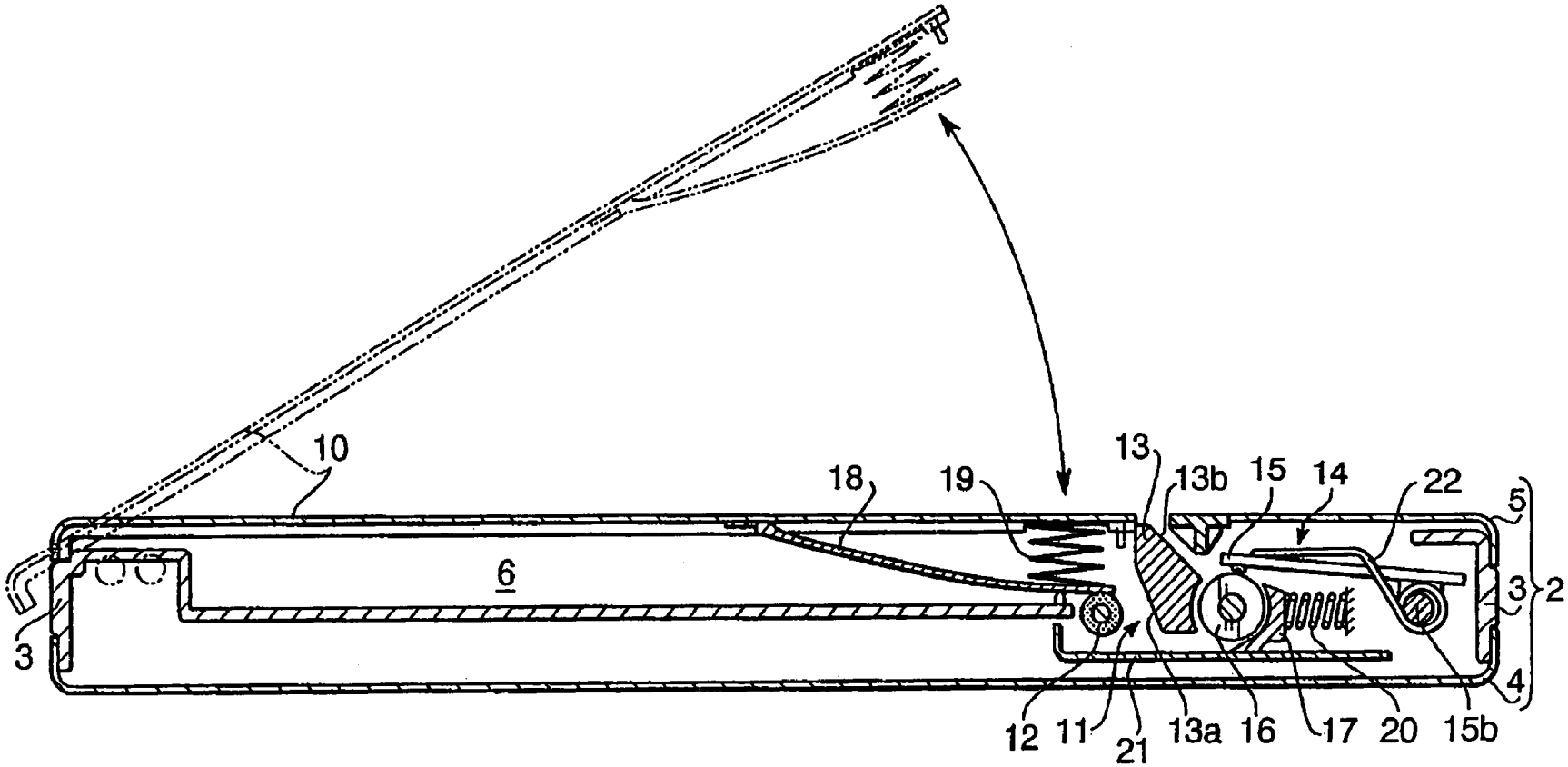
FIG. 2 is a sectional side view of the printer in accordance with the embodiment.
Figure 3:
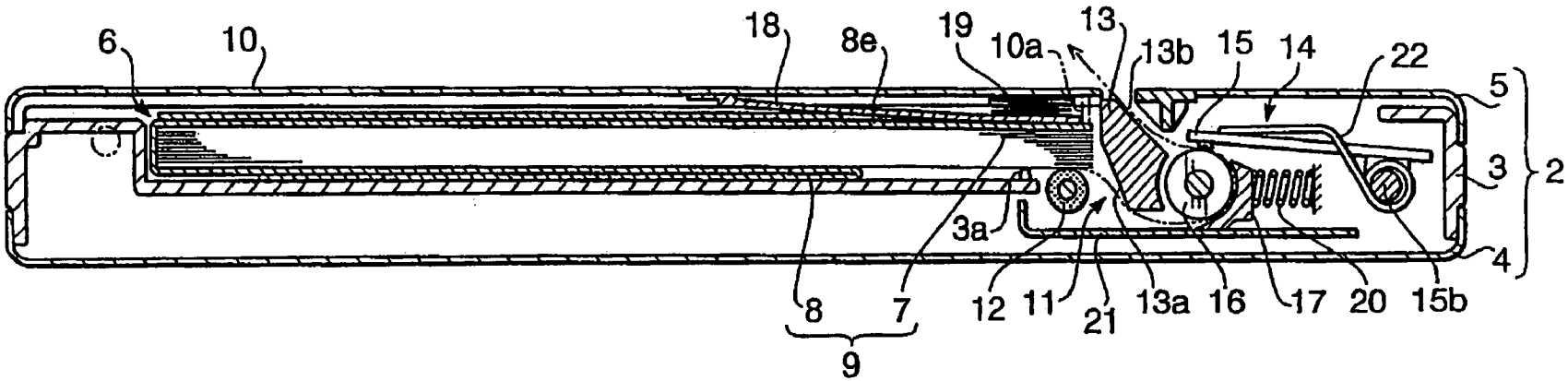
FIG. 3 is a sectional side view showing a state in which print sheets are set in a sheet storage unit of the printer.
Figure 4:
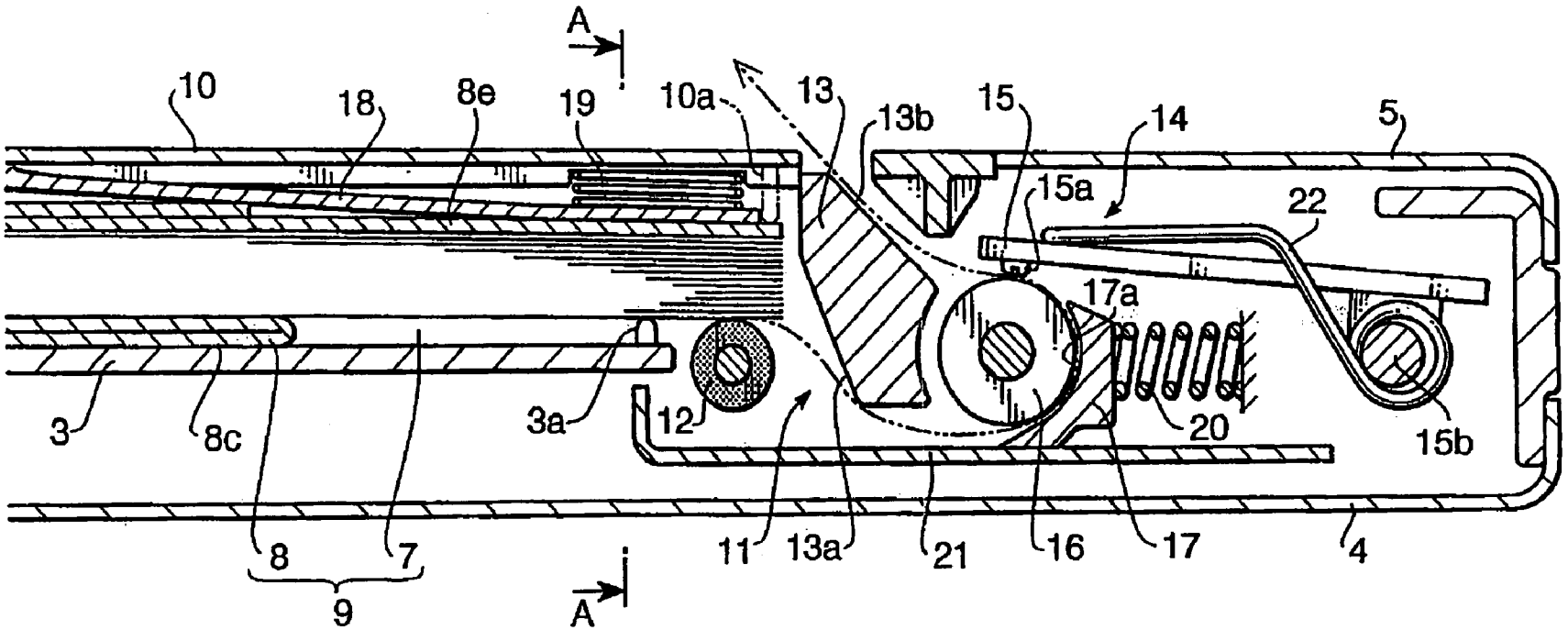
FIG. 4 is an enlarged sectional view showing the details of a sheet separation unit and a print mechanism unit.
Figure 5:
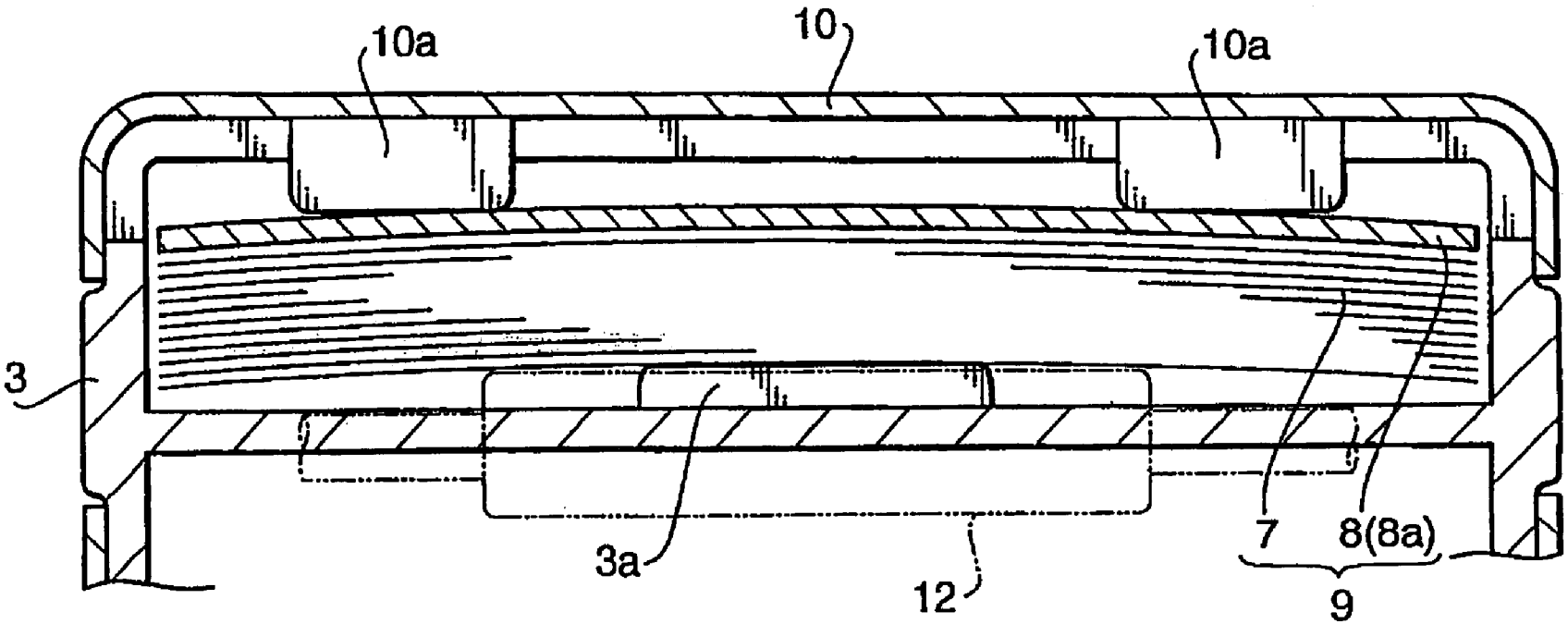
FIG. 5 is a cross-sectional view taken along the line A—A shown in FIG. 4.
Figure 6:
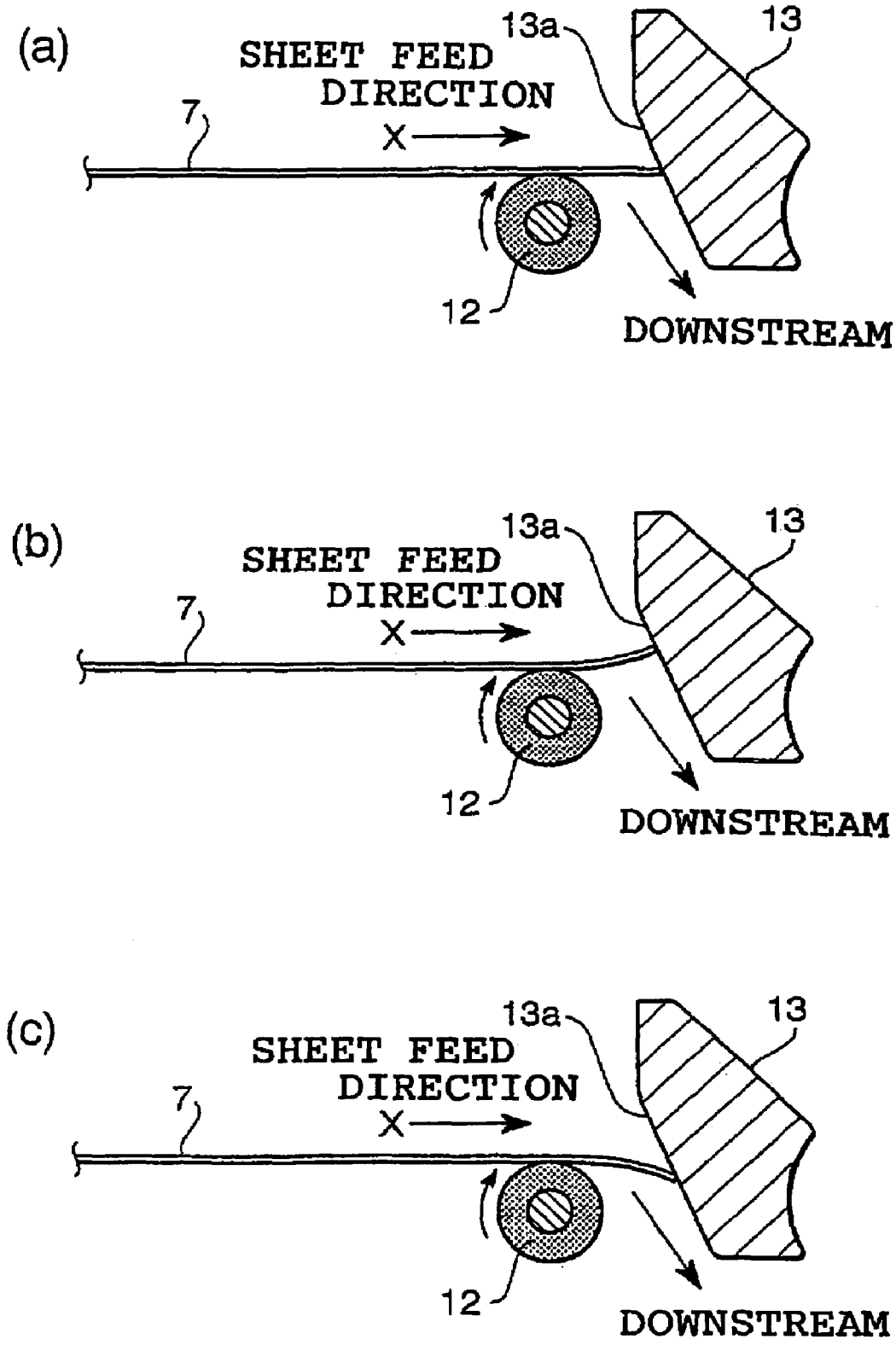
FIG. 6 is a partial sectional view showing the direction of the front end of the sheet making contact with a separation guide surface in the sheet storage unit.

FIG. 1 is a perspective view of a printer 1. FIG. 2 is a sectional side view of the printer 1. FIG. 3 is a sectional side view showing a state in which print sheets are set in a sheet storage unit. FIG. 4 is an enlarged sectional view showing the details of a sheet separation unit and a print mechanism unit. FIG. 5 is a cross-sectional view taken along the line A—A shown in FIG. 4. FIG. 6 is a partial sectional view showing the direction of the front end of the sheet making contact with a separation guide surface in the sheet storage unit.

First, the overall configuration of the printer 1 will be described referring to FIGS. 1 through 4.

The printer 1 of the embodiment of the present invention is a thermal printer which is formed compact in size, with a rectangular shape of approximately A6 size or A7 size in a plan view and a thickness of approximately 2 cm or less.

The printer 1 has a body case 2. The body case 2 includes a frame 3, a lower cover 4 covering the bottom of the frame 3, and an upper cover 5 covering part of the top of the frame 3.

In a part of the upper part of the frame 3 that is not covered with the upper cover 5, a sheet storage unit (sheet supply unit) 6 is formed as shown in FIG. 2. In the sheet storage unit 6, a sheet package 9 (see FIG. 3) is inserted and set. The sheet package 9 is a package formed by storing a plurality of heat-sensitive cut sheets 7 of A6–A7 size (record mediums, hereinafter referred to as "sheets 7") in a package member 8.

The top of the sheet storage unit 6 is covered with a lid 10 which is rotatable with respect to the body case 2 as shown in FIG. 2. The body case 2 is provided with an unshown lock mechanism, by which the lid 10 can be locked at a closed position as shown in FIG. 3 with the sheet package 9 loaded in the sheet storage unit 6. as described above.

At one end (right end in FIG. 2) of the sheet storage unit 6, a sheet separation unit 11 including a pickup roller 12, a separation block 13, etc. is placed. Beneath the upper cover 5, a print mechanism unit (printing unit) 14 (described in detail later) including a thermal head 15, a platen roller 16 and a paper guide 17 is placed.

First, the sheet separation unit 11 will be explained below.

As shown in FIG. 2, to one end of the sheet storage unit 6 in the vicinity of the print mechanism unit 14, the pickup roller 12 and the separation block 13 are provided. On the inner surface of the lid 10 facing the sheet storage unit 6, a pressure plate 18 is supported rotatably.

The pressure plate 18 has approximately the same width as the sheets 7 stored in the sheet package 9. A coil spring 19 is placed between the pressure plate 18 and the lid 10 so as to constantly exert pressure on the pressure plate 18 to rotate it downward (in a direction separating from the inner surface of the lid 10).

The sheets 7 are stacked up in the sheet package with their print surfaces facing downward in the figures. When the sheet package 9 is set in the sheet storage unit 6, the lower surface of the lowermost one of the stacked sheets 7 exposes itself partially from the package member 8. When the lid 10 is closed and locked, the pressure plate 18 is pressed downward by the aforementioned spring 19, by, which the pressure plate 18 presses the part of the sheet 7 exposed from the package member 8 against the pickup roller 12 via the package member 8, letting the lower surface of the sheet 7 contact the pickup roller 12 (see FIG. 3).

The separation block 13, provided in the vicinity of the pickup roller 12, has a separation guide surface 13*a* being tilted with respect to the sheet feed direction of the pickup roller 12.

In this configuration, the pickup roller 12 which is driven and rotated exerts feeding force (rightward in FIG. 3) on the lower most sheet 7 contacting the pickup roller 12. As a principle, the lowermost sheet 7 is conveyed by the feeding force of the pickup roller 12 (caused by the spring 19) exceeding braking force from the separation guide surface 13*a* and negative frictional force from a (second) sheet on the conveyed sheet. The second lowermost sheet on the conveyed sheet receives positive frictional force from the lowermost sheet, negative frictional force from a third lowermost sheet and braking force from the separation guide surface 13*a* and thereby stays at its position with the force balance, by which multi feeding is avoided. With the separating function of the separation guide surface 13*a* of the separation block 13, only one sheet 7 at the bottom of the stacked sheets is separated and conveyed out of the sheet package 9.

Next, the print mechanism unit 14 will be explained below.

The platen roller 16 is rotatably provided next to the separation block 13 (on the right-hand side of the separation block 13 in FIG. 3), and the paper guide 17 is placed close to the exterior surface of the platen roller 16.

As shown in the enlarged view of FIG. 4, the paper guide 17 has a sliding surface 17*a* which is formed to have a concave sectional form like a tilted letter "U" along the exterior surface of the platen roller 16. Between the paper guide 17 and the body case 2, a pressure coil spring 20 is placed so as to press the sliding surface 17*a* against the exterior surface of the platen roller 16.

In this configuration, the sheet 7 separated by the aforementioned sheet separation unit 11 is conveyed by the pickup roller 12 and thereby passes through a gap between the bottom of the separation block 13 and a guide plate 21 for guiding the sheet 7 toward the platen roller 16.

The sheet 7 is guided by the guide plate 21 and fed beneath the platen roller 16 (on the sheet supply side of the print mechanism unit 14) to a gap between the platen roller 16 and the paper guide 17. The sheet 7, held between the exterior surface of the platen roller, 16 and the sliding surface 17*a* of the paper guide 17, is conveyed by the revolving platen roller 16 upward being turned over in the tilted U shape and reaches the top of the platen roller 16 with its print surface facing upward.

The thermal head 15, placed nearby the top of the platen roller 16, has a heating element unit 15*a* as the printing unit. The heating element unit 15*a* is configured in a line, with a plurality of small heating elements arranged in a sheet width direction (direction orthogonal to the plane of FIG. 4). The thermal head 15 is provided to be rotatable around a rotation axis 15*b*, by which the heating element unit 15*a* can contact and separate from the top of the platen roller 16.

Incidentally, the thermal head 15 is designed to be rotatable as above so that the thermal head 15 will not disturb a "jammed paper clearance operation" for clearing the sheet 7 when the sheet 7 has got jammed between the platen roller 16 and the paper guide 17.

To the thermal head 15, an end of a spring 22 of a twisting coil spring type is attached, by which force for pressing the heating element unit 15*a* against the top of the platen roller 16 is applied to the thermal head 15 constantly.

When the sheet 7 is conveyed to the top of the platen roller 16 with its print surface facing upward as above, the heating element unit 15*a* of the thermal head 15 makes contact with the upper surface of the sheet 7 and the printing on the sheet 7 is carried out at the contacting part.

The thermal head 15 is capable of printing arbitrary letters, images, etc. on the conveyed heat-sensitive sheet 7, by executing printing on each line orthogonal to the sheet feed direction. The print width on each line is set to a width which is approximately the same as the width of the sheet 7 as the target of printing.

Such a thermal head 15 is employed as the printing head for the following reasons. By use of the heat-sensitive sheets as the record mediums, consumable items like ink, ink ribbons, etc. become unnecessary and mechanisms such as an ink supply mechanism can be omitted, by which the printer 1 can be designed compact in size.

As the heat-sensitive sheet, various types of print sheets, such as a heat-coloring sheet having a color layer which takes on a color when heated by the thermal head 15, a heat-perforated sheet which is made by coating a base layer with a perforation layer (perforated by heating), etc. can be employed.

On the aforementioned separation block 13, a sheet ejection guide surface 13*b*, tilted relative to the sheet feed direction of the platen roller 16, is formed.

The sheet 7 after the printing by the heating element unit 15*a* of the thermal head 15 is guided by the sheet ejection guide surface 13*b* and thereby ejected toward the upside of the lid 10 through a gap between the lid 10 and the upper cover 5 of the body case 2 as shown in FIG. 1.

As described above, in the printer 1 of this embodiment, one side of the stack of sheets 7 set in the sheet storage unit (sheet supply unit) 6 is in contact with the driven and rotated pickup roller 12, extracted from the stack by the pickup roller 12, and makes contact with the separation guide surface 13*a* of the separation block 13 at its front end. By the separating function of the separation guide surface 13*a*, one sheet is guided and fed to the sheet supply side of the print mechanism unit (printing unit) 14.

As mentioned before, the sheet 7 extracted from the stack by the pickup roller 12 has make contact with the separation guide surface 13*a* in a proper direction.

Specifically, for a satisfactory sheet separating function of the separation guide surface 13*a*, the front end of the sheet 7 fed by the pickup roller 12 has to make contact with the separation guide surface 13*a* straightly in a proper direction as shown in FIG. 6(*a*).

Meanwhile, when the front end of the sheet 7 gets substantially orthogonal to the separation guide surface 13*a* as shown in FIG. 6(*b*) due to curl of the sheet 7, the front end can not slide along the separation guide surface 13*a* and thereby the sheet 7 can not be carried downstream, resulting in misfeeding of the sheet 7. On the other hand, when the front end of the sheet 7 heads downward to move along the separation guide surface 13*a* as shown in FIG. 6(*c*) due to curl of the sheet 7, the separating function of the separation guide surface 13*a* becomes insufficient, resulting in multi feeding in which two or more sheets are fed simultaneously to the downstream side.

In this point of view, in this embodiment, a pair of first ribs 10*a* (forcible curling unit) are provided at both sides (right and left sides in the sheet width direction) of the lid 10 so as to protrude downward toward the pickup roller 12 side, and a second rib 3*a* (forcible curling unit) is provided at the middle (in the sheet width direction) of the frame 3 (forming the bottom of the sheet storage unit 6) so as to protrude upward toward the lid 10, as shown in FIGS. 4 and 5.

With the pair of first ribs 10*a* and the second rib 3*a*, even when the sheet has curled in the sheet feed direction, the sheet is forcibly curled in the sheet width direction by the ribs 10*a* and 3*a* when the lid 10 is closed, by which the curl in the sheet feed direction (orthogonal to the sheet width direction) is eliminated. Thus, even with sheets curled in the sheet feed direction, the front end of each sheet is oriented in the proper direction as shown in FIG. 6(*a*), without making contact with the separation guide surface 13*a* in the direction shown in FIG. 6(*b*) or 6(*c*).

In the case of FIG. 6(*a*) where the sheet contacts the separation guide surface 13*a* in the proper direction, the separating function of the separation guide surface 13*a* is accomplished normally even if the sheet has the curl in the sheet width direction.

While the explanation is made with regard to a case where the first ribs 10*a* and the second rib 3*a* are provided for the printer as the forcible curling unit in the above embodiment, the forcible curling unit is not restricted to such configuration.

Even with the first ribs 10*a* or the second rib 3*a* only, the sheet 7 can be curled in the sheet width direction and thereby the preventive effect against the misfeeding and multi feeding can be attained.

The forcible curling unit is only required to curl the sheet 7 to curve in the sheet width direction before the sheet contacts the separation guide surface 13*a* of the separation block 13, therefore, the construction of the forcible curling unit is not limited to the above embodiment.

For example, it is also possible to provide ribs to the pressure plate 18 which is attached to the lid 10 instead of providing the first ribs 10*a* directly to the lid 10. By such configuration, even when the number of sheets remaining in the sheet package decreases, the pressure plate 18 moves toward the pickup roller 18 accordingly together with the ribs, by which the effect for curving the sheets 7 in the sheet width direction can be achieved stably.

In the above embodiment, the sheets 7 are stored in the package member 8 and set in the sheet storage unit 6 in the form of the sheet package 9. By such configuration, even when the sheets stored in the sheet package have curled in the sheet feed direction, the sheets are forcibly curled in the sheet width direction to lose the curl in the sheet feed direction when the sheet package is set in the printer, by which the misfeeding and multi feeding of the sheets can be prevented from occurring as described above.

As described above, by the embodiment in accordance with the present invention, the direction of the curl (tendency to curl) of the sheets is forcibly set in the sheet width direction (orthogonal to the sheet feed direction) when the sheets are set in the printer. Therefore, the sheets can be separated and fed correctly and smoothly.

While the above embodiment has been described as an illustration, the present Invention is not to be restricted by the above particular illustrative embodiment but to be appreciated on the basis of the appended claims.

What is claimed is:

1. A printer, comprising:

a sheet supply unit that accommodates a stack of sheets therein;

a pickup roller which contacts and drives one side of the stack of sheets accommodated in the sheet supply unit and thereby feeds each sheet toward a printing unit;

a cover which covers the other side of the stack of sheets accommodated in the sheet supply unit; and a forcible curling unit which forcibly curls the sheets accommodated in the sheet supply unit in a sheet width direction, wherein the forcible curling unit reduces curling of the sheets during feeding in a sheet feed direction that is substantially perpendicular to the sheet width direction, wherein the forcible curling unit includes a rib which is provided inside the sheet supply unit to protrude toward the cover so that a tip of the rib will press the stack of sheets accommodated in the sheet supply unit at its central part in regard to the sheet width direction, and wherein the cover is provided with a pressure plate which applies pressure on the sheets accommodated in the sheet supply unit toward the pickup roller, the pressure plate being separate from, and attached to the cover in such a manner as to cause the sheets to curl in the sheet width direction, the pressure plate having a width that is substantially same as a width of the sheets.

2. The printer according to claim 1, wherein the sheets are accommodated in the sheet supply unit in the form of a sheet package including a package member containing the sheets.

3. The printer according to claim 1, wherein the forcible curling unit includes ribs which are provided to the pressure plate to protrude toward the pickup roller so that tips of the ribs are capable of pressing the stack of sheets accommodated in the sheet supply unit at both sides in regard to the sheet width direction.

4. The printer according to claim 1, the sheets having a tendency of curling along a sheet length direction when not being pressed by the forcible curling unit.

5. A printer, comprising:

a sheet supply unit that accommodates a stack of sheets therein;

a pickup roller which contacts and drives one side of the stack of sheets accommodated in the sheet supply unit and thereby feeds each sheet toward a printing unit;

a cover which covers the other side of the stack of sheets accommodated in the sheet supply unit; and a forcible curling unit which forcibly curls the sheets accommodated in the sheet supply unit in a sheet width direction, wherein the forcible curling unit includes a pressure plate and ribs, the pressure plate having a width that is substantially same as a width of the sheets, the ribs being provided to the cover to protrude toward the pickup roller so that tips of the ribs press, via the pressure plate, the stack of sheets accommodated in the sheet supply unit at both sides in regard to the sheet width direction so as to cause the sheets to curl in the sheet width direction.

6. A printer, comprising:

a sheet supply unit that accommodates a stack of sheets therein;

a pickup roller which contacts and drives one side of the stack of sheets accommodated in the sheet supply unit and thereby feeds each sheet toward a printing unit;

a cover which covers the other side of the stack of sheets accommodated in the sheet supply unit; and a forcible curling unit which forcibly curls the sheets accommodated in the sheet supply unit in a sheet width direction, wherein the cover is provided with pressing means which applies pressure on the sheets accommodated in the sheet supply unit toward the pickup roller, the pressing means being separate from, and attached to the cover, the pressing means having a width that is substantially same as a width of the sheets and being disposed in such a manner as to cause the sheets to curl in the sheet width direction; and wherein the forcible curling unit includes ribs which are provided to the pressing means to protrude toward the pickup roller so that tips of the ribs are capable of pressing the stack of sheets accommodated in the sheet supply unit at both sides in regard to the sheet width direction.

7. A printer, comprising:

a sheet supply unit that accommodates a stack of sheets therein;

a pickup roller which contacts and drives one side of the stack of sheets accommodated in the sheet supply unit and thereby feeds each sheet toward a printing unit;

a sheet separation unit provided on a downstream side of the sheet supply unit in a sheet feed direction; and a forcible curling unit which forcibly curls the sheets in a sheet width direction at a position immediately before the sheet separation unit, wherein the forcible curling unit reduces curling of the sheets during feeding in a sheet feed direction that is substantially perpendicular to the sheet width direction, wherein the forcible curling unit includes a rib which is provided inside the sheet supply unit to protrude toward a cover so that a tip of the rib presses the stack of sheets accommodated in the sheet supply unit at its central part in regard to the sheet width direction, and wherein the cover is provided with a pressure plate which applies pressure on the sheets accommodated in the sheet supply unit toward the pickup roller, the pressure plate being disposed in such a manner as to cause the sheets to curl in the sheet width direction, the pressure plate having a width that is substantially same as a width of the sheets.

8. A sheet feeding mechanism, comprising:

a sheet supply unit that accommodates a stack of sheets therein;

a pickup roller which contacts and drives one side of the stack of sheets accommodated in the sheet supply unit and thereby feeds each sheet toward a printing unit;

a sheet separation unit placed on a downstream side of the sheet supply unit in a sheet feed direction; and a forcible curling unit which forcibly curls the sheets accommodated in the sheet supply unit in a sheet width direction, wherein the forcible curling unit reduces curling of the sheets during feeding in a sheet feed direction that is substantially perpendicular to the sheet width direction, wherein the forcible curling unit includes a rib which is provided inside the sheet supply unit to protrude toward a cover so that a tip of the rib presses the stack of sheets accommodated in the sheet supply unit at its central part in regard to the sheet width direction, and wherein the cover is provided with a pressure plate which applies pressure on the sheets accommodated in the sheet supply unit toward the pickup roller, the pressure plate being separate from, and attached to the cover in such a manner as to cause the sheets to curl in the sheet width direction, the pressure plate having a width that is substantially same as a width of the sheets.

* * * * *